US008757272B2

(12) United States Patent
Couturier et al.

(10) Patent No.: US 8,757,272 B2
(45) Date of Patent: Jun. 24, 2014

(54) METHOD AND APPARATUS FOR PRECISE CONTROL OF WELLBORE FLUID FLOW

(75) Inventors: Yawan Couturier, Katy, TX (US); Donald G. Reitsma, Katy, TX (US); Ossama R. Sehsah, Katy, TX (US)

(73) Assignee: Smith International, Inc., Houston, TX (US)

( * ) Notice: Subject to any disclaimer, the term of this patent is extended or adjusted under 35 U.S.C. 154(b) by 281 days.

(21) Appl. No.: 12/884,288

(22) Filed: Sep. 17, 2010

(65) Prior Publication Data

US 2012/0067591 A1 Mar. 22, 2012

(51) Int. Cl.
*E21B 34/06* (2006.01)

(52) U.S. Cl.
USPC ..... 166/373; 166/91.1; 175/48

(58) Field of Classification Search
USPC ..... 166/373, 91.1, 386, 316; 175/38, 218, 175/48, 40, 45
See application file for complete search history.

(56) References Cited

U.S. PATENT DOCUMENTS

| | | | | |
|---|---|---|---|---|
| 3,362,487 | A * | 1/1968 | Lindsey | 175/38 |
| 6,904,981 | B2 | 6/2005 | van Riet | |
| 7,350,597 | B2 | 4/2008 | Reitsma | |
| 7,395,878 | B2 | 7/2008 | Reitsma et al. | |
| 2007/0151762 | A1 * | 7/2007 | Reitsma | 175/40 |
| 2007/0246263 | A1 | 10/2007 | Reitsma | |

FOREIGN PATENT DOCUMENTS

JP 200953455 A 9/2009

OTHER PUBLICATIONS

International Preliminary Report on Patentability for International Application No. PCT/US23011/051898 dated Mar. 28, 2013.

* cited by examiner

*Primary Examiner* — Yong-Suk (Philip) Ro
(74) *Attorney, Agent, or Firm* — Seongyoune Kang; Richard A. Fagin

(57) ABSTRACT

A method for controlling flow of fluid from an annular space in a wellbore includes changing a flow restriction in a fluid flow discharge line from the wellbore annular space. The flow restriction is changed at a rate related to a difference between at least one of a selected fluid flow rate out of the wellbore and an actual fluid flow rate out of the wellbore, and a selected fluid pressure in the annular space and an actual pressure in the annular space.

19 Claims, 4 Drawing Sheets

METHOD AND APPARATUS FOR PRECISE CONTROL OF WELLBORE FLUID FLOW

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of drilling wellbores through subsurface rock formations. More specifically, the invention relates to techniques for safely drilling wellbores through rock formations using an annular pressure control system with a precise wellbore fluid outlet control.

2. Background Art

A drilling system and methods for control of wellbore annular pressure are described in U.S. Pat. No. 7,395,878 issued to Reitsma et al. and incorporated herein by reference. The system generally includes what is referred to as a "back-pressure system" that uses various devices to maintain a selected pressure in the wellbore. Such selected pressure may be at the bottom of the wellbore or any other place along the wellbore.

An important part of the system described in the '878 patent as well as other systems used to maintain wellbore annulus pressure is a controllable flow area "choke" or similar controllable flow restrictor. The controllable flow restrictor may be actuated by devices such as hydraulic cylinders, electric and/or hydraulic motors or any other device used to move the active elements of a controllable flow restrictor.

In the case of hydraulic cylinders used as actuators, for example, one issue that is not effectively addressed is the tradeoff between speed of operation of the actuator, and the accuracy of control. Speed of operation of the actuator may be increased by increasing the control pressure or by increasing the actuator piston surface area. With such increase in operating speed, it becomes increasingly difficult to precisely control the position of the actuator in response to pressure variations in the wellbore. "Overshoot" and "undershoot" of the actuator from the instantaneously correct position is common. Conversely, if the actuator operating speed is reduced by reducing the operating pressure or decreasing the piston surface area, it is possible to make the actuator operate too slowly to response to rapid wellbore pressure variations.

Accordingly, there is a need for a more effective actuator for controllable flow restrictors that does not require a tradeoff between speed of operation and accuracy of position control.

SUMMARY OF THE INVENTION

A method for controlling flow of fluid from an annular space in a wellbore according to one aspect of the invention includes changing a flow restriction in a fluid flow discharge line from the wellbore annular space. The flow restriction is changed at a rate related to a difference between at least one of a selected fluid flow rate out of the wellbore and an actual fluid flow rate out of the wellbore, and a selected fluid pressure in the annular space and an actual pressure in the annular space.

A choke control system according to another aspect of the invention for maintaining selected fluid flow out of a wellbore includes a variable orifice choke disposed in a fluid discharge line from the wellbore. An actuator is operably coupled to the choke. A system controller is operably coupled to the actuator. A rate controller is operably coupled to the actuator and to the controller. The rate controller is configured to change a speed of motion of the actuator. The system controller is configured to operate the rate controller such that the speed of motion is related to an amount of change in the orifice of the choked required to change fluid flow out of the wellbore from an actual value to a selected value.

A method for controlling flow of fluid through a conduit according to another aspect of the invention includes changing a flow restriction in the conduit. The flow restriction is changed at a rate related to a difference between at least one of a selected fluid flow rate through the conduit and an actual fluid flow rate through the conduit, and a selected fluid pressure in the conduit and an actual pressure in the conduit.

Other aspects and advantages of the invention will be apparent from the following description and the appended claims.

DETAILED DESCRIPTION

The description of an example implementation of the invention that follows is explained in terms of a control valve (controllable orifice choke, or similarly designated device) that provides a controllable restriction of flow of fluid out of a wellbore. The controlled restriction may be used for, among other purposes, maintaining a selected fluid pressure within the wellbore. It should be understood that the present invention has application beyond control of fluid discharge from a wellbore, as will be apparent from the following description and claims.

Figure 1:
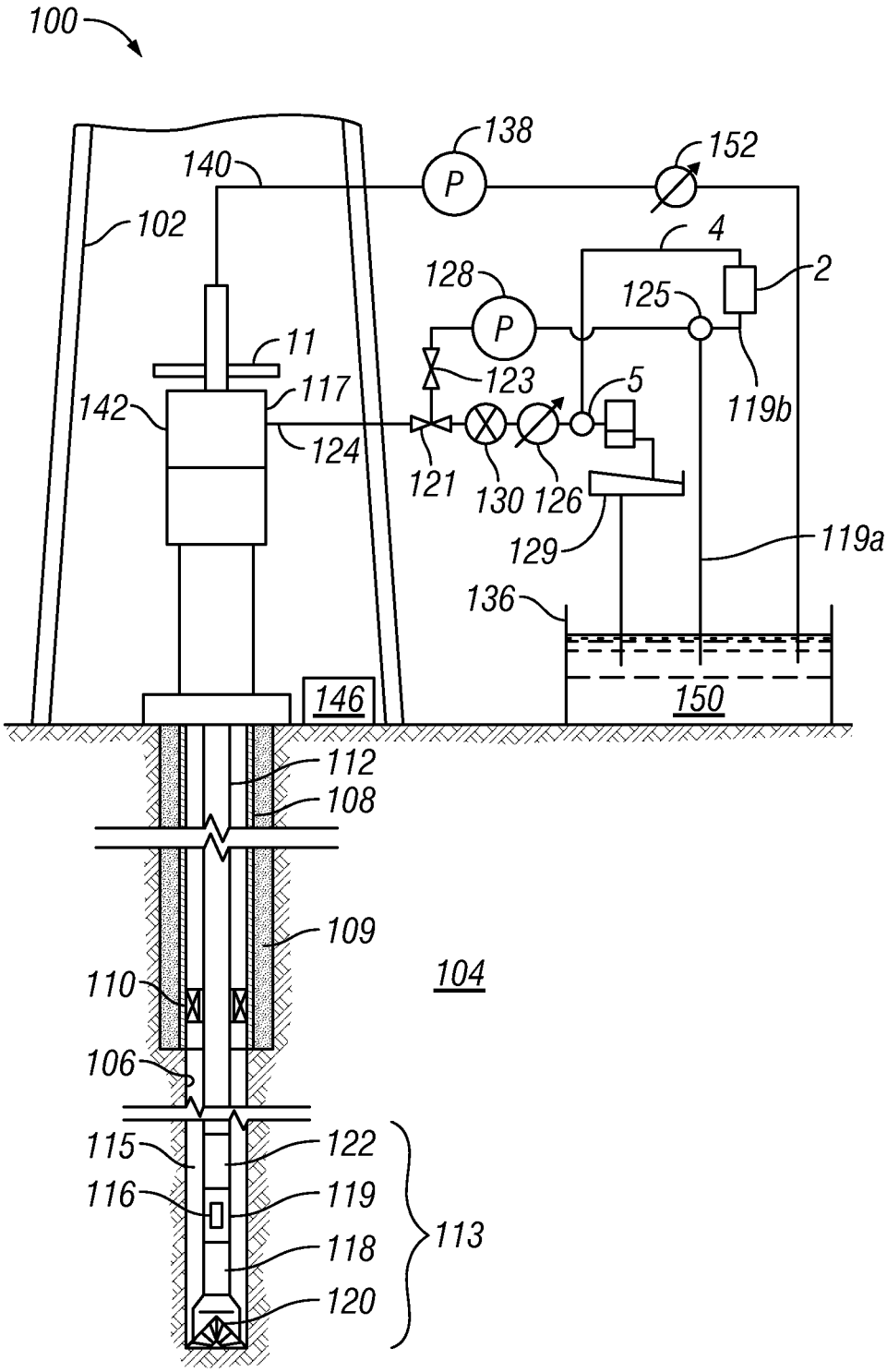
FIG. 1 is an example drilling system using dynamic annular pressure control.

FIG. 1 is a plan view of a drilling system having a dynamic annular pressure control (DAPC) system that can be used with some implementations the invention. It will be appreciated that either a land based or an offshore drilling system may have a DAPC system as shown in FIG. 1, and the land based system shown in FIG. 1 is not a limitation on the scope of the invention. The drilling system 100 is shown including a drilling rig 102 that is used to support drilling operations. Certain components used on the drilling rig 102, such as the kelly, power tongs, slips, draw works and other equipment are not shown separately in the Figures for clarity of the illustration. The rig 102 is used to support a drill string 112 used for drilling a wellbore through Earth formations such as shown as formation 104. As shown in FIG. 1 the wellbore 106 has already been partially drilled, and a protective pipe or casing 108 set and cemented 109 into place in the previously drilled portion of the wellbore 106. In the present example, a casing shutoff mechanism, or downhole deployment valve, 110 may be installed in the casing 108 to shut off the annulus and effectively act as a valve to shut off the open hole section of the wellbore 106 (the portion of the wellbore 106 below the bottom of the casing 108) when a drill bit 120 is located above the valve 110.

The drill string 112 supports a bottom hole assembly (BHA) 113 that may include the drill bit 120, an optional hydraulically powered ("mud") motor 118, an optional measurement- and logging-while-drilling (MWD/LWD) sensor system 119 that preferably includes a pressure transducer 116 to determine the annular pressure in the wellbore 106. The drill string 112 may include a check valve (not shown) to prevent backflow of fluid from the annulus into the interior of the drill string 112 should there be pressure at the surface of the wellbore. The MWD/LWD suite 119 preferably includes a telemetry system 122 that is used to transmit pressure data, MWD/LWD sensor data, as well as drilling information to the Earth's surface. While FIG. 1 illustrates a BHA using a mud pressure modulation telemetry system, it will be appreciated that other telemetry systems, such as radio frequency (RF), electromagnetic (EM) or drill string transmission systems may be used with the present invention.

The drilling process requires the use of drilling fluid 150, which is typically stored in a tank, pit or other type of reservoir 136. The reservoir 136 is in fluid communications with one or more rig mud pumps 138 which pump the drilling fluid 150 through a conduit 140. The conduit 140 is hydraulically connected to the uppermost segment or "joint" of the drill string 112 (using a swivel in a kelly or top drive). The drill string 112 passes through a rotating control head or "rotating BOP" 142. The rotating BOP 142, when activated, forces spherically shaped elastomeric sealing elements to rotate upwardly, closing around the drill string 112 and isolating the fluid pressure in the wellbore annulus, but still enabling drill string rotation and longitudinal movement. Commercially available rotating BOPs, such as those manufactured by National Oilwell Varco, 10000 Richmond Avenue, Houston, Tex. 77042 are capable of isolating annulus pressures up to 10,000 psi (68947.6 kPa). The fluid 150 is pumped down through an interior passage in the drill string 112 and the BHA 113 and exits through nozzles or jets (not shown separately) in the drill bit 120, whereupon the fluid 150 circulates drill cuttings away from the bit 120 and returns the cuttings upwardly through the annular space 115 between the drill string 112 and the wellbore 106 and through the annular space formed between the casing 108 and the drill string 112. The fluid 150 ultimately returns to the Earth's surface and is diverted by the rotating BOP 142 through a diverter 117, through a conduit 124 and various surge tanks and telemetry receiver systems (not shown separately).

Thereafter the fluid 150 proceeds to what is generally referred to herein as a backpressure system which may consist of a choke 130, valve 123 and pump pipes and optional pump as shown at 128. The fluid 150 enters the backpressure system 131 and may flow through an optional flow meter 126.

The returning fluid 150 proceeds to a wear resistant, controllable orifice choke 130. It will be appreciated that there exist chokes designed to operate in an environment where the drilling fluid 150 contains substantial drill cuttings and other solids. Choke 130 is preferably one such type and is further capable of operating at variable pressures, variable openings or apertures, and through multiple duty cycles. Position of the choke 130 may be controlled by an actuator (see 126A in FIG. 2), which may be an hydraulic cylinder/piston combination, for example as will be explained with reference to FIG. 5.

The fluid 150 exits the choke 130 and flows through a valve 121. The fluid 150 can then be processed by an optional degasser 1 and by a series of filters and shaker table 129, designed to remove contaminants, including drill cuttings, from the fluid 150. The fluid 150 is then returned to the reservoir 136. A flow loop 119A is provided in advance of a three-way valve 125 for conducting fluid 150 directly to the inlet of the backpressure pump 128. Alternatively, the backpressure pump 128 inlet may be provided with fluid from the reservoir 136 through conduit 119B, which is in fluid communication with the trip tank (not shown). The trip tank (not shown) is normally used on a drilling rig to monitor drilling fluid gains and losses during pipe tripping operations (withdrawing and inserting the full drill string or substantial subset thereof from the wellbore). The three-way valve 125 may be used to select loop 119A, conduit 119B or to isolate the backpressure system. While the backpressure pump 128 is capable of utilizing returned fluid to create a backpressure by selection of flow loop 119A, it will be appreciated that the returned fluid could have contaminants that would not have been removed by filter/shaker table 129. In such case, the wear on backpressure pump 128 may be increased. Therefore, the preferred fluid supply for the backpressure pump 128 is conduit 119A to provide reconditioned fluid to the inlet of the backpressure pump 128.

In operation, the three-way valve 125 would select either conduit 119A or conduit 119B, and the backpressure pump 128 may be engaged to ensure sufficient flow passes through the upstream side of the choke 130 to be able to maintain backpressure in the annulus 115, even when there is no drilling fluid flow coming from the annulus 115. In the present embodiment, the backpressure pump 128 is capable of providing up to approximately 2200 psi (15168.5 kPa) of pressure; though higher pressure capability pumps may be selected at the discretion of the system designer.

The system can include a flow meter 152 in conduit 100 to measure the amount of fluid being pumped into the annulus 115. It will be appreciated that by monitoring flow meters 126, 152 and thus the volume pumped by the backpressure pump 128, it is possible to determine the amount of fluid 150 being lost to the formation, or conversely, the amount of formation fluid entering to the wellbore 106. Further included in the system is a provision for monitoring wellbore pressure conditions and predicting wellbore 106 and annulus 115 pressure characteristics.

Figure 2:
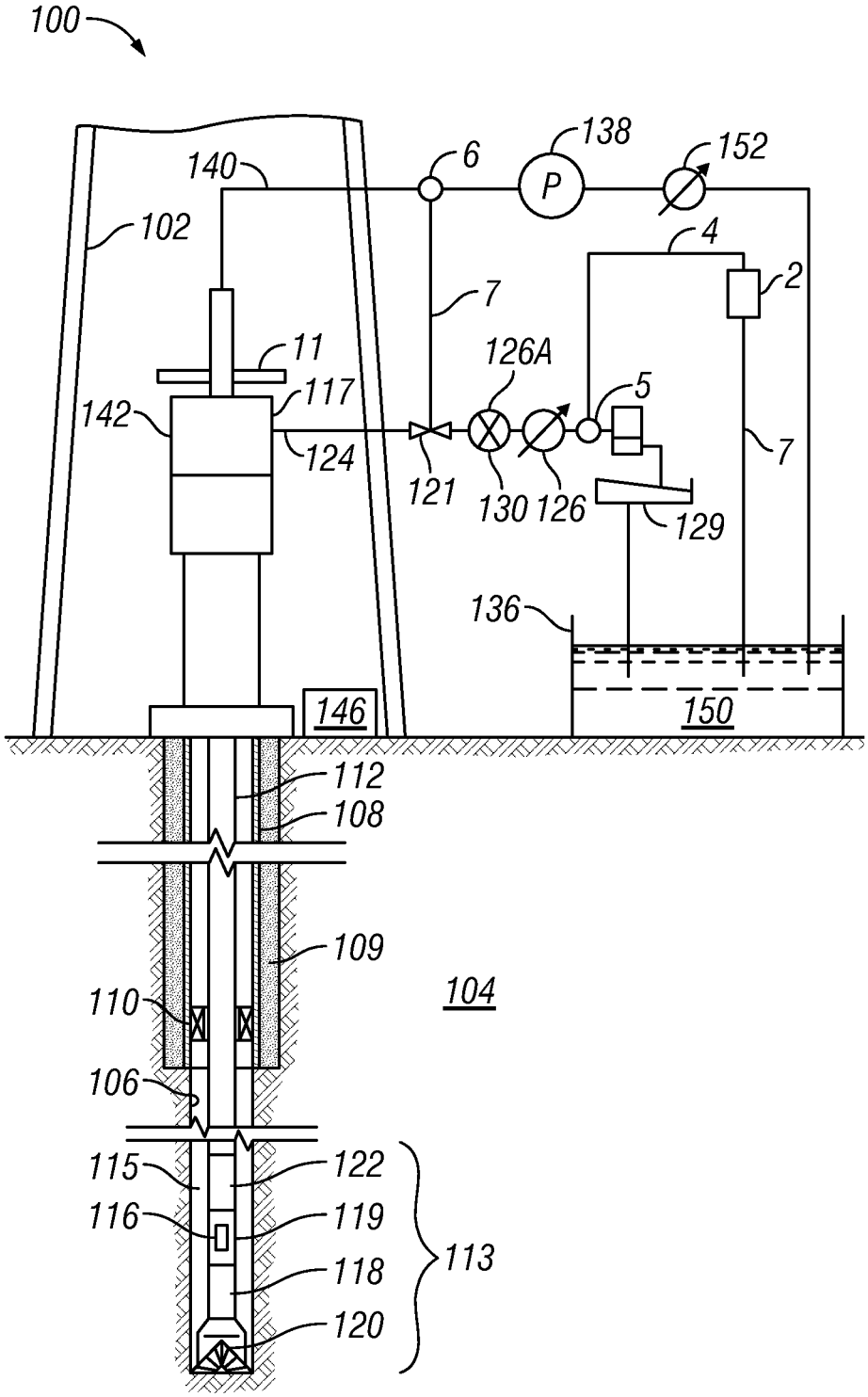
FIG. 2 is an example drilling system using an alternative embodiment of dynamic annular pressure control.

FIG. 2 shows an alternative example of the drilling system. In this embodiment the backpressure pump is not required to maintain sufficient flow through the choke 130 when the flow through the wellbore needs to be shut off for any reason. In this embodiment, an additional three-way valve 6 is placed downstream of the drilling rig mud pumps 138 in conduit 140. This valve 6 allows fluid from the rig mud pumps 138 to be completely diverted from conduit 140 to conduit 7, thus diverting flow from the rig pumps 138 that would otherwise enter the interior passage of the drill string 112. By maintaining action of rig pumps 138 and diverting the pumps' 138 output to the annulus 115, sufficient flow through the choke 130 to control annulus backpressure is ensured.

It will be appreciated that embodiments of a system and method according to the invention may include a gauge or sensor (not shown in the Figures) that measures the fluid level in the pit or tank 136. An actuator system 126A is used to select the size of the choke orifice or flow restriction as required. The choke 130 may be used to control the pressure in the wellbore by only allowing a selected amount of fluid to be discharged from the wellbore annulus such that the discharge rate and/or pressure at a selected point in the wellbore remains essentially at a selected value. The selected value may be constant or some other value. The actuator system 126A will be described in more detail below with reference to FIGS. 4 and 5.

Figure 3:
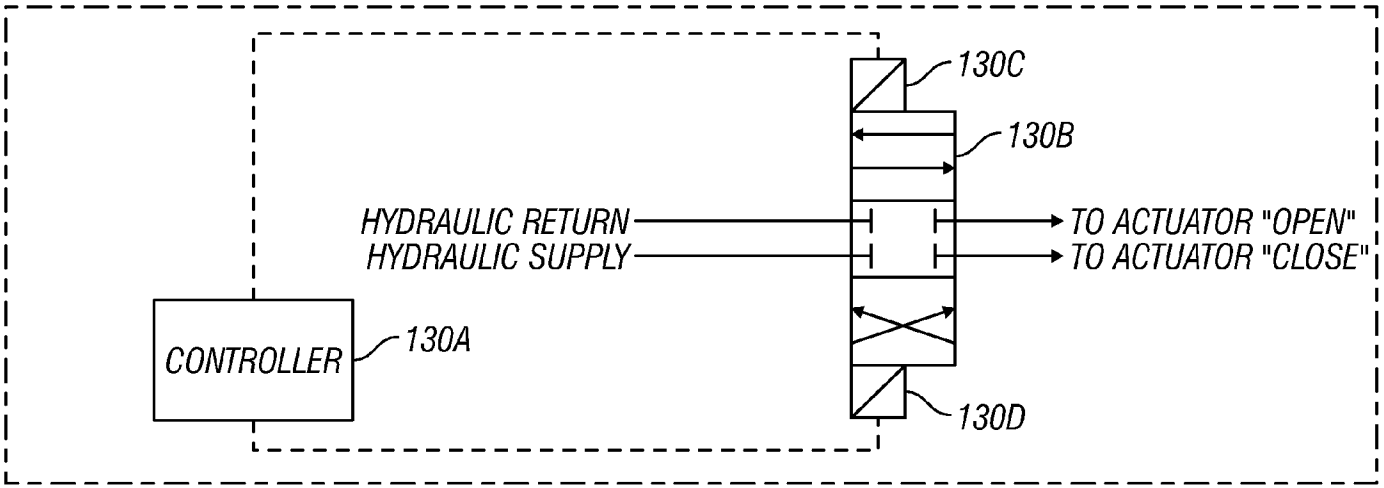
FIG. 3 (Prior Art)
FIG. 3 is schematic diagram of a prior art choke actuator.

Referring to FIG. 3, an actuator system 126A for the choke (130 in FIG. 1) known in the art prior to the present invention is shown schematically to help with understanding of the invention. The prior art actuator system 126A may include a three way valve 130B actuated in opposed directions from a neutral position (neutral position as shown in FIG. 3) by one or more solenoids 130C, 130D. In the center or neutral position as shown in FIG. 3, the hydraulic cylinder (FIG. 5) used to actuate the choke (130 in FIG. 1) is hydraulically closed on both sides of the piston (FIG. 5) therein. Similarly, hydraulic lines from an hydraulic pressure source such as a pump (FIG. 5) and a low pressure return line to an hydraulic reservoir (FIG. 5) are closed. Movement of the three wave valve 130B by a respective one of the solenoids 130C, 130D to either end position will apply hydraulic pressure to one side of the piston (FIG. 5) to move it in one direction, while the opposite side thereof is exposed to the low pressure return line. Operation of the solenoids 130C, 130D may be performed by a controller 130A. The controller 130A may be operated by a DAPC system controller (e.g., as explained with reference to FIG. 1 and FIG. 2) to automatically maintain selected choke position according to pressure required in the wellbore, or the controller 130A may be manually operated using suitable operator input controls (not shown).

Figure 4:
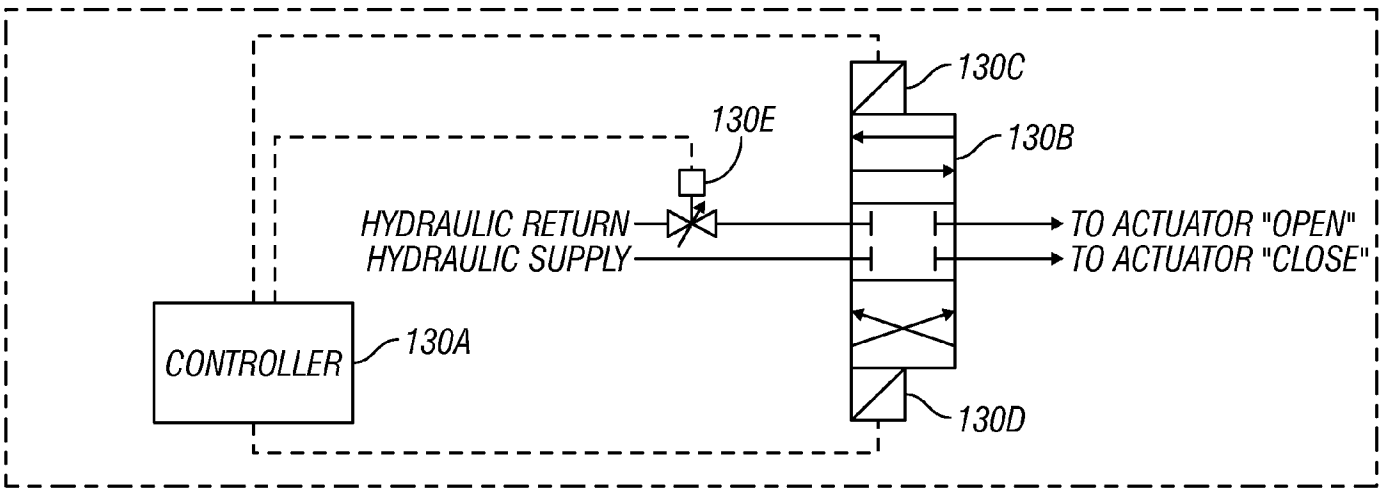
FIG. 4 is a schematic diagram of an example choke actuator control according to the invention.
Figure 5:
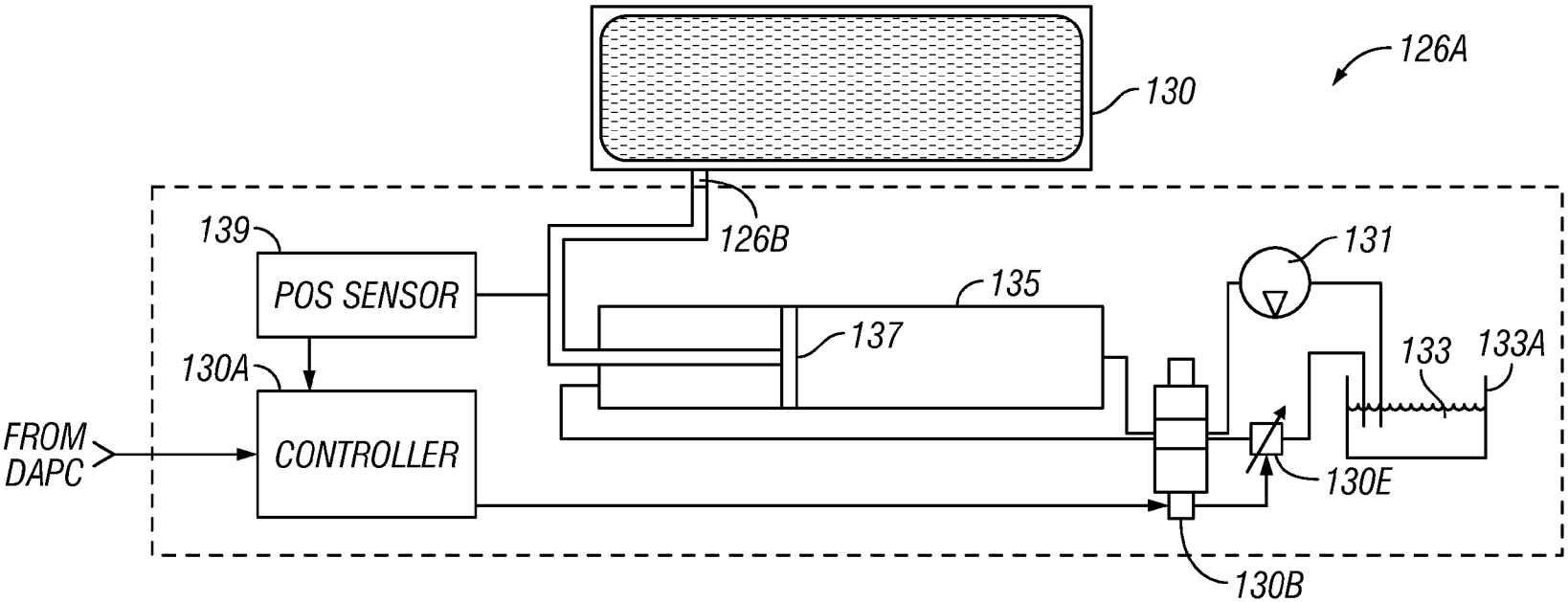
FIG. 5 shows the choke actuator control of FIG. 4 coupled to an hydraulic choke actuator.

As explained in the Background section herein, using high hydraulic pressure and/or a large diameter actuator piston with an hydraulic actuator may provide rapid operation of the choke actuator, but may provide imprecise control over the final position of the choke actuator. Referring to FIG. 4, a choke actuator control system according to the invention includes all the components of FIG. 3, and also includes a variable flow restrictor such as a variable orifice hydraulic control 130E disposed in the low pressure return line. In the present example, the controller 130A may include operating instructions to selectively close the hydraulic control 130E to increase back pressure on the hydraulic return line. Increased back pressure on the hydraulic return line will decrease the movement rate of the piston (FIG. 5) in the choke actuator system 126A. In one example, the controller 130A may be programmed to select the amount of back pressure (or the amount of closure of the control 130E) to be inversely related to the amount of movement required of the choke actuator. In such example, as the choke actuator (e.g., piston in FIG. 5) moves closer to its final required position, the back pressure in the hydraulic system is progressively increased, thereby slowing the movement of the actuator piston (FIG. 5). Progressively slowed movement may reduce the possibility of overshoot or undershoot of the final required position of the choke actuator.

FIG. 5 shows an example of the system of FIG. 4 in connection with the choke (or variable flow restrictor) actuator. Hydraulic pressure to operate the actuator may be provided by a pump 131 that draws hydraulic fluid 133 from a reservoir 133A. High pressure from the pump 131 is directed to one of the two ports on one side of the three way hydraulic valve 130B. The ports on the other side of the valve 130B may be in hydraulic communication with respective ends of an hydraulic cylinder 135. The previously described piston 137 is disposed in the cylinder 135 an is operatively coupled to a flow control 126B forming part of the variable orifice choke 130 or flow restrictor. Thus, movement of the piston 137 is translated into movement of the choke control 126B. A position of the piston 137 and or the choke control 126B may be determined by a position sensor 139, for example, a linear variable differential transformer (LVDT) or any other type of linear or rotary position sensor or encoder. Position sensor 139 signals may be conducted to the controller 130A. As explained with reference to FIG. 4, the controller 130A may generate signals to operate either of the solenoids on the three way valve 130B to control direction of movement of the piston 137 or to stop the piston 137. Rate of movement of the piston 137 may be controlled by the variable orifice 130E in the hydraulic return line to the reservoir 133A. The variable orifice 130E may be operated by the controller 130A as explained with reference to FIG. 4. In the present example, the controller 130A may operate the variable orifice 130E to cause the piston 137 to move with a speed inversely related to its distance from the determined final position (e.g., as measured by the position sensor 139). Alternatively, the speed of motion of the piston 137 may be related to a difference between the currently measured wellbore annulus pressure or flow rate of fluid out of the wellbore (see FIG. 1 and FIG. 2) and the required wellbore annulus pressure or flow rate out of the wellbore. As the measured wellbore pressure and/or flow rate out of the wellbore approaches the required value, the controller 130A may progressively close the variable orifice 130E to reduce the piston 137 speed.

A system and method according to the present invention may provide more precise control over wellbore pressure while maintaining speed of operation of a wellbore pressure control so that responsiveness to rapid pressure variations is maintained.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for controlling flow of fluid from an annular space in a wellbore, comprising:

changing an amount of flow restriction in a fluid flow discharge line from the wellbore annular space, the amount of flow restriction changed at a rate that increases as a difference increases, and decreases as the difference decreases, the difference being one of a first difference and a second difference, the first difference being between a selected fluid flow rate out of the wellbore and a measured fluid flow rate out of the wellbore, and the second difference being between a selected fluid pressure in the annular space and a measured pressure in the annular space.

2. The method of claim 1 wherein the changing the amount of flow restriction comprises changing an orifice size of a variable orifice choke.

3. The method of claim 2 wherein the changing orifice size comprises operating an actuator coupled to an orifice size control in the choke.

4. The method of claim 3 wherein the actuator is operated by applying hydraulic pressure to one side of a piston disposed in the actuator.

5. The method of claim 4 wherein the rate is controlled by applying a controllable restriction to flow of hydraulic fluid from the other side of the piston.

6. The method of claim 4 wherein the rate is selected in response to an actual position of the actuator with respect to a position thereof resulting in the selected fluid flow rate or the selected pressure.

7. The method of claim 6 wherein the actual position of the actuator is determined by measurements from a position sensor.

8. The method of claim 7 wherein the position sensor comprises a linear position sensor.

9. The method of claim 5 wherein the controllable restriction comprises a variable orifice.

10. A method for controlling flow of fluid through a conduit, comprising:

changing an amount of flow restriction in the conduit, the amount of flow restriction changed at a rate that decreases as a difference decreases and increases as the difference increases between one of a first difference and a second difference, the first difference being between a selected fluid flow rate out of the wellbore and a measured fluid flow rate out of the wellbore, and the second difference being between a selected fluid pressure in the annular space and a measured pressure in the annular space.

11. The method of claim 10 wherein the amount of the flow restriction is controlled by operating a three way valve in hydraulic communication with a source of hydraulic pressure.

12. The method of claim 10 wherein the changing the amount of flow restriction comprises changing an orifice size of a variable orifice valve.

13. The method of claim 12 wherein the changing orifice size comprises operating an actuator coupled to an orifice size control in the valve.

14. The method of claim 13 wherein the actuator is operated by applying hydraulic pressure to one side of a piston disposed in the actuator.

15. The method of claim 14 wherein the rate is controlled by applying a controllable restriction to flow of hydraulic fluid from the other side of the piston.

16. The method of claim 15 wherein the controllable restriction comprises a variable orifice.

17. The method of claim 13 wherein the rate is selected in response to an actual position of the actuator with respect to a position thereof resulting in the selected fluid flow rate or the selected pressure.

18. The method of claim 17 wherein the actual position of the actuator is determined by measurements from a position sensor.

19. The method of claim 18 wherein the position sensor comprises a linear position sensor.

* * * * *